US008777359B1

(12) United States Patent
Mealy

(10) Patent No.: US 8,777,359 B1
(45) Date of Patent: Jul. 15, 2014

(54) FIRE TIMING CONTROL IN PRINTING DEVICES

(71) Applicant: Marvell International Ltd., Hamilton (BM)

(72) Inventor: James Mealy, Corvallis, OR (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/027,988

(22) Filed: Sep. 16, 2013

Related U.S. Application Data

(60) Continuation of application No. 13/762,247, filed on Feb. 7, 2013, now Pat. No. 8,534,790, which is a division of application No. 12/702,193, filed on Feb. 8, 2010, now Pat. No. 8,371,669.

(60) Provisional application No. 61/153,482, filed on Feb. 18, 2009.

(51) Int. Cl.
*B41J 29/38* (2006.01)
*B41J 2/115* (2006.01)

(52) U.S. Cl.
CPC ..... *B41J 2/115* (2013.01)
USPC ..... 347/14; 347/5; 347/10; 347/11

(58) Field of Classification Search
USPC ..... 347/5, 10, 11, 14
See application file for complete search history.

(56) References Cited

U.S. PATENT DOCUMENTS

| | | | | |
|---|---|---|---|---|
| 5,589,858 | A * | 12/1996 | Kadowaki et al. | 347/14 |
| 7,019,481 | B2 | 3/2006 | Kato et al. | |
| 7,278,697 | B2 * | 10/2007 | Plunkett | 347/5 |
| 7,449,850 | B2 | 11/2008 | Muroi | |
| 2007/0103493 | A1 | 5/2007 | Tsukada et al. | |
| 2007/0103496 | A1 | 5/2007 | Otani | |

* cited by examiner

*Primary Examiner* — Laura Martin

(57) ABSTRACT

Some of the embodiments of the present disclosure provide a method for generating each of (i) a first signal and (ii) a second signal based at least in part on a position of a carriage, where the carriage is a component of a printing device, estimating (i) a major cycle duration associated with the first signal and (ii) a first minor cycle duration associated with the second signal, estimating a position of the carriage based at least in part on the estimated major cycle duration and the estimated first minor cycle duration, and generating a plurality of print synchronization pulses based at least in part on the estimated position of the carriage.

20 Claims, 9 Drawing Sheets

FIRE TIMING CONTROL IN PRINTING DEVICES

CROSS REFERENCE TO RELATED APPLICATIONS

The present disclosure is a continuation of and claims priority to U.S. patent application Ser. No. 13/762,247, filed Feb. 7, 2013, now U.S. Pat. No. 8,534,790, issued Sep. 17, 2013, which is a divisional of and claims priority to U.S. patent application Ser. No. 12/702,193, filed Feb. 8, 2010, now U.S. Pat. No. 8,371,669, issued Feb. 12, 2013, which claims priority to U.S. Provisional Patent Application No. 61/153,482, filed Feb. 18, 2009, which are incorporated herein by reference.

TECHNICAL FIELD

Embodiments of the present invention relate to printing devices in general, and more specifically to controlling fire timing in printing devices.

BACKGROUND

Unless otherwise indicated herein, the approaches described in this section are not prior art to the claims in this application and are not admitted to be prior art by inclusion in this section.

A printing device (e.g., an ink jet printer) typically has a carriage that sweeps across a printing medium (e.g., paper). Between sweeps, the printing medium is advanced in a direction that is orthogonal to a direction of the carriage sweep. A printing head is usually mounted on the carriage. During movement of the carriage, ink droplets are fired from the printing head to target positions on the printing medium so that printing is performed.

In order to produce uniform images, the deposition (or spitting) of the ink from the printing head has to be timed such that ink is deposited at regularly spaced intervals on the printing medium. The quality of the printed image depends, among other factors, on how regularly the ink is deposited on the printing medium. If the ink is deposited in a non-uniform (e.g., irregular) manner on the printing medium, then the print quality can visibly suffer.

To increase and/or maintain quality of the print job, it may be desirable to relatively accurately control the fire timing of ink droplets, even if, for example, the carriage is moving at a relatively high velocity, is accelerating and/or is decelerating. Such high velocity, acceleration and/or deceleration may be desirable in high speed printers, in fast printing modes, and/or for printing pages that are relatively sparsely populated.

SUMMARY

In various embodiments, the present disclosure provides an apparatus and a method for generating each of (i) a first signal and (ii) a second signal based at least in part on a position of a carriage, where the carriage is a component of a printing device, estimating (i) a major cycle duration associated with the first signal and (ii) a first minor cycle duration associated with the second signal, estimating a position of the carriage based at least in part on the estimated major cycle duration and the estimated first minor cycle duration, and generating a plurality of print synchronization pulses based at least in part on the estimated position of the carriage. In various embodiments, a major cycle duration corresponds to a time duration between one of either the last two rising edges of the first signal or the last two falling edges of the first signal. In various embodiments, a minor cycle duration corresponds to a time duration between one of either the last two rising edges of the first signal or the last two falling edges of the second signal.

BRIEF DESCRIPTION OF THE DRAWINGS

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in embodiments," which may each refer to one or more of the same or different embodiments. The phrase "in some embodiments" is used repeatedly. The phrase generally does not refer to the same embodiments; however, it may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B." The phrase "at least one of A, B and C" means (A), (B), (C), (A and B), (A and C), (B and C) or (A, B and C). The phrase "(A) B" means (B) or (A and B), that is, A is optional.

Figure 1:
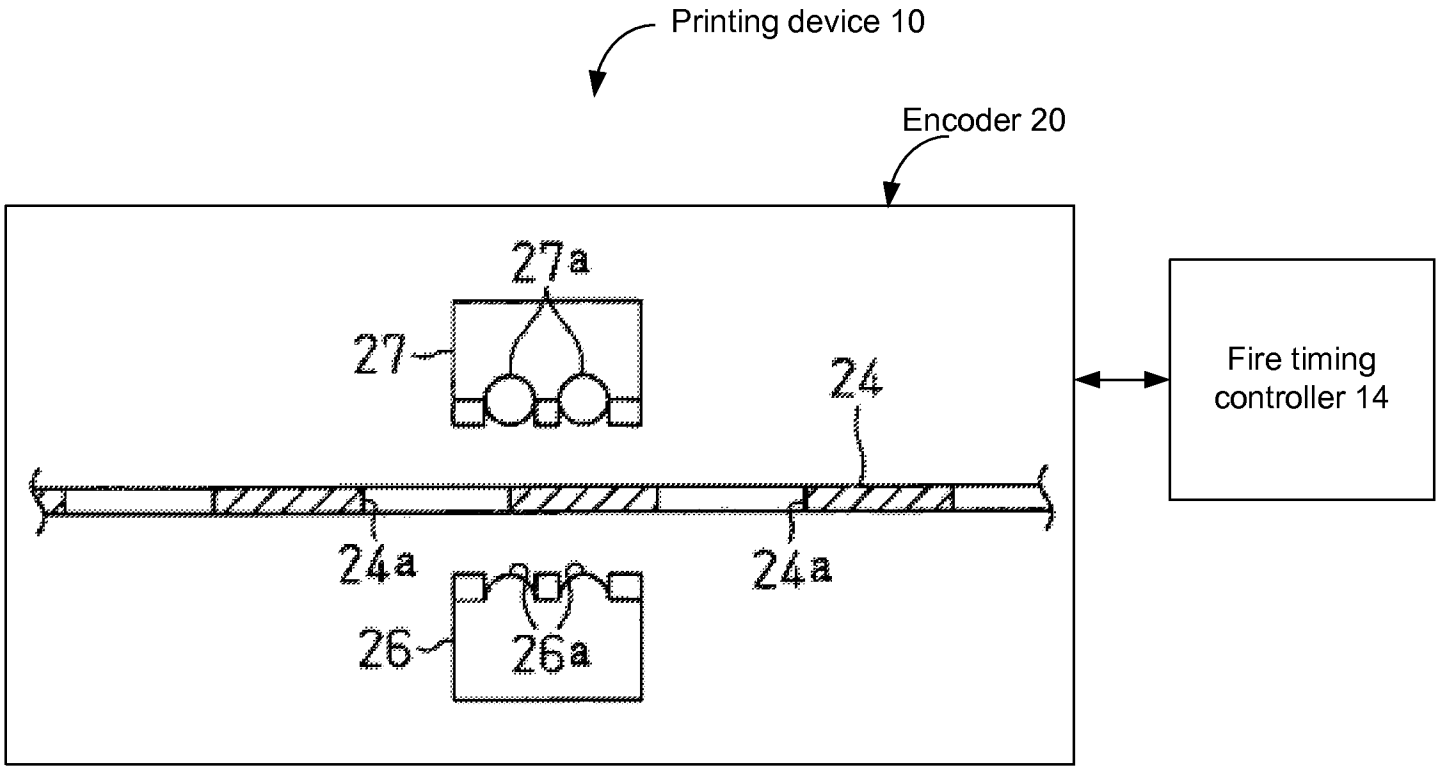
FIG. 1 schematically illustrates a printing device comprising an encoder operatively coupled to a fire time controller, in accordance with various embodiments of the present disclosure.

FIG. 1 schematically illustrates a printing device 10 comprising an encoder 20 operatively coupled to a fire time controller 14. The printing device 10 may be any appropriate printing device, e.g., an inkjet printer. Although not illustrated in FIG. 1, the printing device 10 includes several other components. For example, the printing device 10 includes a carriage that is driven (e.g., driven bi-directionally) by an appropriate motor, through a timing belt. A printing head, mounted on the carriage, fires or ejects ink droplets from one or more cartridges (e.g., a black ink cartridge and/or a color ink cartridge coupled to the printing head) to a printing medium. Between sweeps of the carriage, the printing medium moves in a direction that is orthogonal to the primary scanning direction (i.e., direction in which the carriage traverses).

The encoder 20 includes a detection tape 24 (also referred to as "slit tape 24") in which a plurality of slits 24*a* is formed at regular intervals. In one example, about 180 slits may be formed in one inch length of the slit tape 24. The slit tape 24 is set to be parallel to the primary scanning direction. The slit tape 24 is stationary, i.e., does not move with the carriage or the printing medium.

The encoder 20 also includes a sensor comprising a light emitting element 26 and a light receiving element 27. The sensor is attached to the carriage, and traverses along with the carriage in the primary scanning direction. The slit tape 24 is interposed between the light emitting element 26 and the light receiving element 27.

The light emitting element 26 has a pair of light emitting sections 26*a*. The light receiving element 27 has a pair of light receiving sections 27*a*. The pair of light receiving sections 27*a* is aligned with respect to the pair of light emitting sections 26*a*, such that light from each of the pair of light emitting sections 26*a* reaches the respective light receiving section of the pair of light receiving sections 27*a*, through slits 24*a*, when the sensor is appropriately positioned.

The slit tape 24 (e.g., the length of the slits 24*a*, and distance between any two slits) is arranged such that an encoder signal A (also referred herein as "signal A") is deviated from an encoder signal B (also referred herein as "signal B") by, for example, ¾ cycle. The signals A and B have a number of pulses corresponding to the number of times light passes through each of the slits 24*a* when the carriage of the printing device 10 is scanned. The pair of light receiving sections 27*a* in the encoder is offset so that they produce the two square wave signals A and B that are offset by about 90 degrees in phase. Each of the signals A and B are output from the light receiving sections 27*a*. The signals A and B are representative of the movement of the carriage and also the direction of movement.

In various embodiments, the fire timing controller 14 is configured to receive the signals A and B, estimate position, velocity and/or acceleration of the carriage from the received signals A and B, and control ink fire timing of the printing device 10 (e.g., control ink fire timing of the printing head), as will be discussed in more detail herein later.

Figure 2A:
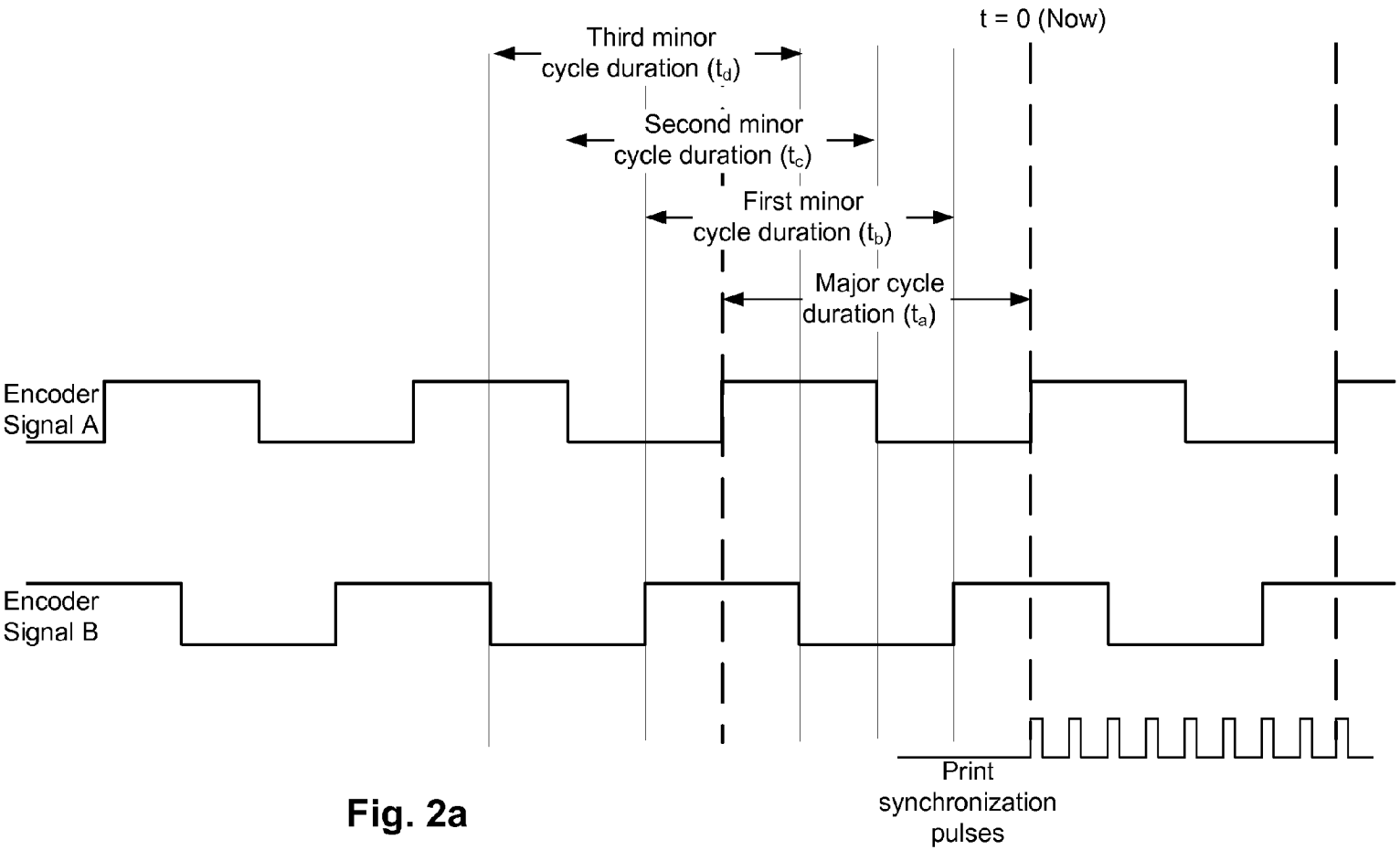
FIG. 2*a* illustrates signal A and signal B output by the encoder of FIG. 1, in accordance with various embodiments of the present disclosure.

FIG. 2*a* illustrates signal A and signal B output by the encoder 20 of FIG. 1. As previously discussed and as illustrated in FIG. 2*a*, the two signals A and B are offset by about 90 degrees in phase. However, in various other embodiments and although not illustrated in FIG. 2*a*, the two signals A and B may be offset in phase by any other appropriate angle.

Referring again to FIG. 2*a*, each of the signals A and B is a square wave signal, having a plurality of rising edges and a plurality of falling edges. In various embodiments, a major cycle may refer to a cycle that corresponds to rising edges of signal A, falling edges of signal A, rising edges of signal B, or falling edges of signal B. That is, the major cycle may correspond to any one of these four alternatives. For the embodiments discussed herein in this disclosure, a major cycle corresponds to rising edges of signal A. Thus, signal A has a number of major cycles, with individual major cycle corresponding to two consecutive rising edges of signal A. Although the major cycle is assumed to correspond to rising edges of signal A, the inventive principles of this disclosure are not limited to this aspect. For example, in various other embodiments, the major cycle corresponds to falling edges of signal B.

Additionally, in various embodiments, a first minor cycle corresponds to rising edges of signal B, a second minor cycle corresponds to falling edges of signal A, and a third minor cycle corresponds to falling edges of signal B. However, in various other embodiments, the first, second and third minor cycles may correspond to any other appropriate combination of the rising or falling edges of signals A or B (e.g., may correspond to falling edges of signal A, rising edges of signal B, and falling edges of signal B, respectively).

Thus, signal B has a plurality of first minor cycles, with individual cycles of the first minor cycles corresponding to two consecutive rising edges of signal B. Similarly, signal A has a plurality of second minor cycles, with individual cycles of the second minor cycles corresponding to two consecutive falling edges of signal A. Similarly, signal B has a plurality of third minor cycles, with individual cycles of the third minor cycles corresponding to two consecutive falling edges of signal B.

As referred to herein in this disclosure, unless otherwise mentioned, a major cycle duration $t_a$ refers to a duration of the last cycle of the major cycles. Thus, the major cycle duration refers to a time duration between the last two rising edges of signal A, as illustrated in FIG. 2*a*.

As referred to herein in this disclosure, unless otherwise mentioned, a first minor cycle duration $t_b$ refers to a duration of the last cycle of the first minor cycles. Thus, the first minor cycle duration $t_b$ refers to the time duration between the last two rising edges of signal B, as illustrated in FIG. 2*a*. Similarly, a second minor cycle duration $t_c$ refers to a duration of the last cycle of the second minor cycles. Thus, the second minor cycle duration $t_c$ refers to the time duration between the last two falling edges of signal A. Also, a third minor cycle duration $t_d$ refers to a duration of the last cycle of the third minor cycles. Thus, the third minor cycle duration $t_d$ refers to the time duration between the last two falling edges of signal B.

In FIG. 2*a*, it is assumed that the current time (i.e., t=0) is aligned with the rising edge of the signal A. The major cycle duration $t_a$, the first minor cycle duration $t_b$, the second minor cycle duration $t_c$, and the third minor cycle duration $t_d$ are illustrated accordingly.

Figure 2B:
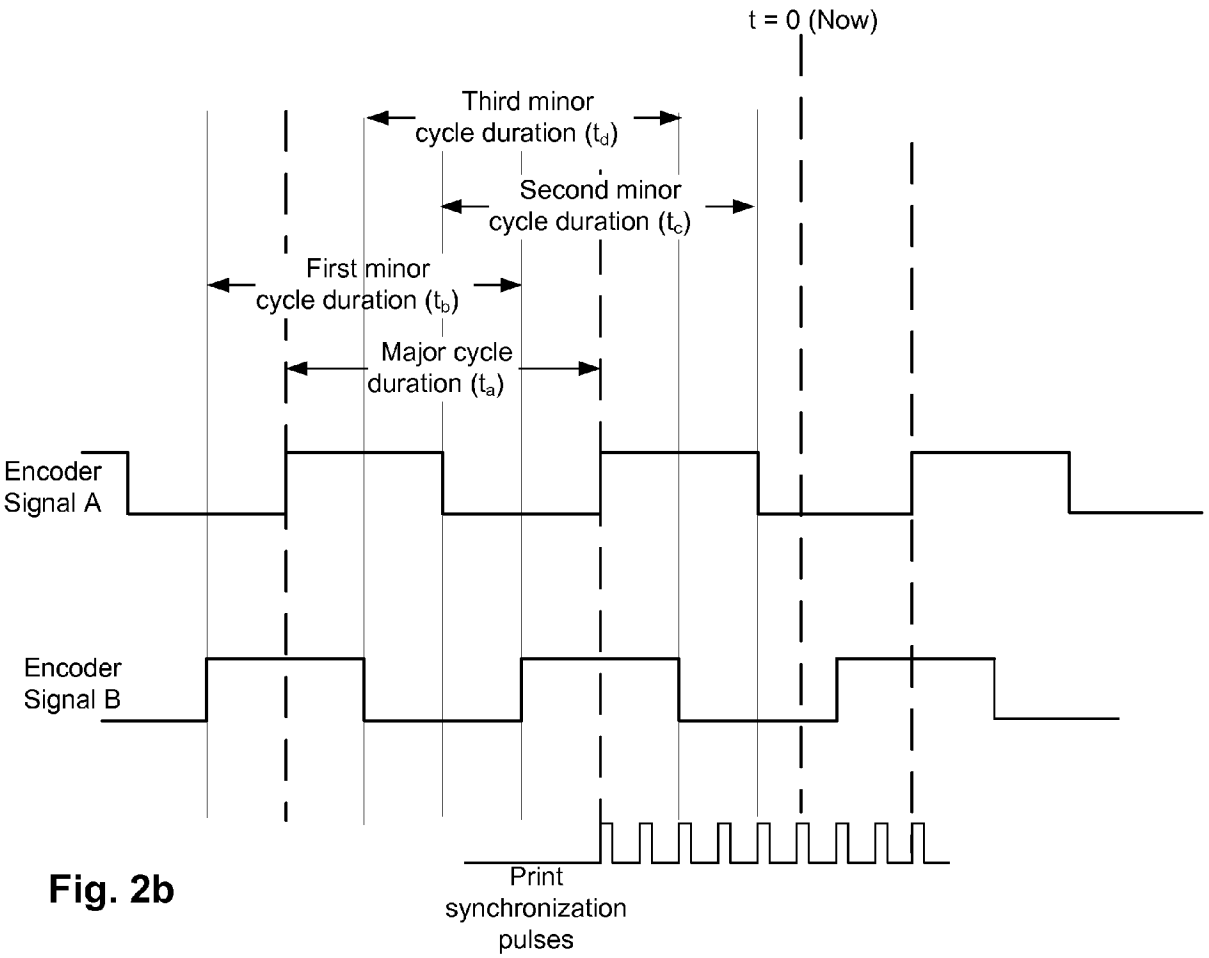
FIG. 2*b* illustrates signal A and signal B, with the current time (i.e., t=0) in between a falling edge of signal A and a rising edge of signal B, in accordance with various embodiments of the present disclosure.

The major and various minor cycle durations (e.g., the first, second and third minor cycle durations) change (e.g., are updated) as time progress. For example, FIG. 2*b* illustrates the signals A and B, with the current time (i.e., t=0) in between a falling edge of signal A and a rising edge of signal B, in accordance with various embodiments of the present disclosure. The major cycle duration $t_a$, the first minor cycle duration $t_b$, the second minor cycle duration $t_c$, and the third minor cycle duration $t_d$ are illustrated accordingly in FIG. 2*b*.

During a major cycle (or one of the various minor cycles), the carriage moves a pre-determined distance over the printing medium. For example, the carriage may move a distance of 1/600 inch over the printing medium during each of the major cycles. If the velocity of the carriage is relatively high, the carriage takes relatively less time to cover this pre-determined distance. On the other hand, if the velocity of the carriage is relatively low, the carriage takes relatively more time to cover this pre-determined distance. Accordingly, durations of individual major cycles (and various minor cycles) are based on the velocity of the carriage. For example, for relatively higher velocity of the carriage the duration of individual major cycles may be small, compared to the duration of individual major cycles when the carriage velocity is relatively lower, and vice versa. However, irrespective of the velocity of the carriage (and irrespective of the duration of individual major cycles), the carriage moves the pre-determined distance (e.g., 1/600 inch) during individual major cycles (or during individual cycles of the various minor cycles).

The fire timing controller 14 generates a plurality of print synchronization pulses, and the printing head ejects ink droplets on the print medium in synchronization with the print synchronization pulses. The print synchronization pulses are generated in synchronization with, for example, major cycles of signal A. For example, the fire timing controller 14 generates N number of print synchronization pulses during individual major cycles. N may be any appropriate integer that depends on, for example, settings of the printer, printing mode of the printer (e.g., normal quality printing mode, better quality printing mode, etc.), type of printing head, and/or the like. For example, N may be as low as 4 (or even lower), as high as 100 (or even higher), or any other appropriate integer. Thus, during a major cycle, the printing head may eject ink droplets N times (based on the print data), in synchronization with the print synchronization pulses.

In various embodiments, during a major cycle, N print synchronization pulses are generated uniformly across the distance the carriage moves during the major cycle. For example, if the carriage moves 1/600 inch during the major cycle, the individual print synchronization pulses are generated each time the carriage moves 1/(600×N) inch, so that the N print synchronization pulses are generated uniformly over the 1/600 inch the carriage moves during the major cycle. FIGS. 2*a* and 2*b* illustrate 8 print synchronization pulses (i.e., N=8) being generated during a major cycle.

In case the velocity of the carriage is uniform (i.e., no acceleration of the carriage), generating print synchronization pulses uniformly across the distance the carriage moves during the major cycle is equivalent to generating print synchronization pulses uniformly, in time, during the major cycle. Put differently, in case the velocity of the carriage is uniform over a major cycle that is estimated to be of M seconds, N print synchronization pulses can be generated at intervals of M/N seconds, such that the N print synchronization pulses are uniformly spaced apart in time (e.g., the N print synchronization pulses are generated at regular time intervals).

However, in case the velocity of the carriage is non-uniform (e.g., while the carriage is accelerating) over a major cycle, generating print synchronization pulses uniformly across the distance the carriage moves during the major cycle is not equivalent to generating print synchronization pulses uniformly in time during the major cycle. Put differently, in case the velocity of the carriage is non-uniform over the major cycle, generating print synchronization pulses at regular time intervals results in the ink droplets being deposited in a non-uniform manner in the printing medium, which may result in poor print quality. In such cases, the print synchronization pulses may have to be generated uniformly across the distance the carriage moves during the major cycle (e.g., instead of being generated at regular time intervals).

Figure 3:
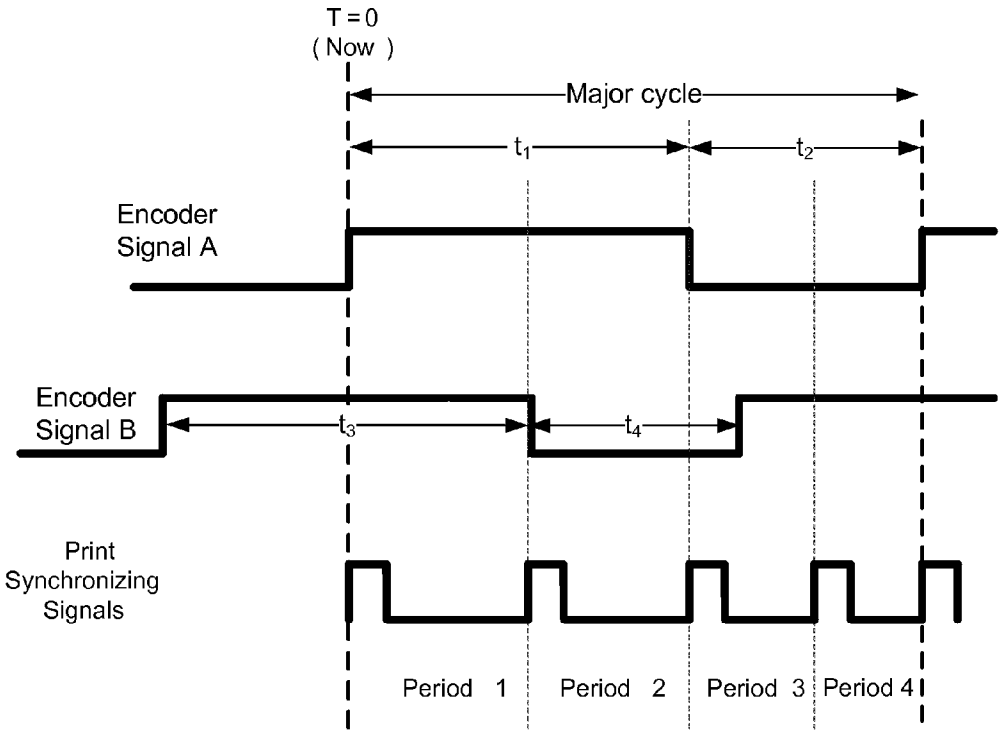
FIG. 3 illustrates timing diagram of signal A and signal B, where a carriage is accelerating during a major cycle, in accordance with various embodiments of the present disclosure.

For example, FIG. 3 illustrates timing diagram of signal A and signal B, where the carriage is accelerating during a major cycle. In FIG. 3, N is assumed to be equal to 4 (i.e., 4 print synchronization pulses are generated during one major cycle). Also, in FIG. 3, period 1 is a time duration between rising edges of a first print synchronization pulse and a second print synchronization pulse, period 2 is a time duration between rising edges of the second print synchronization pulse and a third print synchronization pulse, and so on.

The illustrated major cycle in FIG. 3 includes time duration $t_1$ between the rising and falling edges of signal A, and time duration $t_2$ between the falling and rising edges of signal A. Similarly, FIG. 3 also illustrates time duration $t_3$ between the rising and falling edges of signal B, and time duration $t_4$ between the falling and rising edges of signal B. As illustrated in FIG. 3, $t_2$ is less than t1, and $t_4$ is less than $t_3$, which signifies that the carriage is accelerating (without any acceleration, $t_1$ would have been substantially equal to $t_2$, and $t_3$ would have been substantially equal to $t_4$, as illustrated in FIGS. 2*a* and 2*b*). That is, a velocity of the carriage near the end of the illustrated major cycle is relatively higher than a velocity of the carriage near the beginning of the illustrated major cycle. To compensate for the increase in velocity, the periods of the print synchronization pulses are dynamically decreased. That is, periods 3 and/or 4 are relatively less than periods 1 and/or 2, as illustrated in FIG. 3. Such a decrease in the period of the print synchronization pulses ensures that the print synchronization pulses are generated uniformly across the distance of the carriage (e.g., instead of being generated at regular time intervals) during the major cycle, thereby compensating for the change in velocity. Put differently, the print synchronization pulses are relatively closer in time when the carriage accelerates (or has a relatively high velocity) compared to when the carriage has a relatively low velocity.

Referring again to FIGS. 2*a* and 2*b*, in various embodiments, the major cycle duration $t_a$, first minor cycle duration $t_b$, second minor cycle duration $t_c$ and third minor cycle duration $t_d$ are be used to estimate a current velocity, acceleration and/or position of the carriage. Also, the timings of the print synchronization pulses are estimated based at least in part on the estimated velocity, acceleration and/or position of the carriage.

In the case where the velocity of the carriage is assumed to be uniform (e.g., by ignoring any acceleration of the carriage), a position of the carriage may be estimated by:

$$P=A*t_a+B*t_b+C*t_c+D*t_d, \quad \text{Equation 1}$$

where $t_a$, $t_b$, $t_c$ and $t_d$ are the major cycle duration, first minor cycle duration, second minor cycle duration and third minor cycle duration, respectively, and A, B, C, and D are position weighting coefficients whose sum may be equal to 1 (i.e., A+B+C+D=1). The position weighting coefficients A, B, C and D may be based on various factors, including but not limited to, an average velocity of the carriage, a printing mode of the printing device 10, a desired quality of the printing, settings of the carriage, dynamics of the carriage (e.g., time of flight error, as discussed herein later) and the printing head, and/or the like. In various embodiments, the position weighting coefficients A, B, C and D are estimated empirically, to achieve uniform ejection of ink droplets over the printing medium. For example, the position weighting coefficients A, B, C and D are estimated through a number of experiments, in which the position weighting coefficients A, B, C and D are adjusted or tuned until desirable results (e.g., uniform ejection of ink droplets over the distance of the carriage movement) are achieved.

However, in case the carriage accelerates (i.e., in case the velocity of the carriage changes), additional terms may be introduced to compensate for such acceleration. For example, a dynamic position $P_d$ of the carriage is dynamically estimated by:

$$P_d=P_{initial}+t*(dP/dt), \quad \text{Equation 2}$$

where $P_{initial}$ is an initial position of the carriage, t denotes time since the initial position $P_{initial}$ has been estimated, and dP/dt denotes change in position with respect to time. Thus, dP/dt is representative of the velocity of the carriage. In various embodiments, dP/dt may be estimated by:

$$dP/dt=t*(d^2P/dt), \quad \text{Equation 3}$$

where $d^2P/dt$ denotes change in velocity with respect to time. Thus, $d^2P/dt$ is representative of the acceleration (or deceleration) of the carriage.

In various embodiments, dP/dt and $d^2P/dt$ are estimated as follows:

$$dP/dt=A_v*t_a+B_v*t_b+C_v*t_c+D_v*t_d, \quad \text{Equation 4,}$$

$$d^2P/dt=A_a*t_a+B_a*t_b+C_a*t_c+D_a*t_d, \quad \text{Equation 5}$$

where $A_v$, $B_v$, $C_v$, and $D_v$ are velocity weighting coefficients whose sum may be equal to 1 (i.e., $A_v+B_v+C_v+D_v=1$), and $A_a$, $B_a$, $C_a$, and $D_a$ are acceleration weighting coefficients whose sum may be equal to 1 (i.e., $A_a+B_a+C_a+D_a=1$). The velocity weighting coefficients $A_v$, $B_v$, $C_v$, and $D_v$ and the acceleration weighting coefficients $A_a$, $B_a$, $C_a$, and $D_a$ are computed empirically, to achieve uniform ejection of ink droplets over the printing medium. For example, the velocity weighting coefficients and the acceleration weighting coefficients are estimated through a number of experiments, in which these coefficients are adjusted or tuned until desirable results (e.g., uniform ejection of ink droplets over the distance of the carriage movement) are achieved.

In various embodiments, the position $P_d$ of equation 2 is a relative position of the carriage. For example, in various embodiments, the position $P_d$ is the current position of the carriage relative to a position of the carriage at the beginning of the current major cycle (e.g., $P_{initial}$). The carriage traverses a distance of, for example, Q inches during a major cycle. Thus, the position $P_d$ is 0 inches at the beginning of the major cycle (when t=0, and $P_d=P_{initial}=0$), increase as the carriage traverses along the primary scanning direction, and reaches Q inches by the end of the major cycle. While the carriage is, for example, about half way of the Q inches, then $P_d$ is about (½) Q inches. Once the carriage has covered the entire Q inches (i.e., end of the current major cycle), $P_d$ is reset (e.g., set to 0) for the next major cycle.

In various other embodiments, the position $P_d$ is the current position of the carriage relative to a position of the carriage at the beginning of the current scan line. Thus, the position $P_d$ is 0 inches at the beginning of the scan line (when t=0, and $P_d=P_{initial}=0$), increase as the carriage traverses along the primary scanning direction, and for every major cycle the position $P_d$ is incremented by Q inches. For example, if the carriage has crossed about K number of major cycles, and is about half way of the $(K+1)^{th}$ major cycle, then $P_d$ is about (K*Q+(½)*Q) inches.

In yet other embodiment, the position $P_d$ may be the current position of the carriage relative to any other appropriate position of the carriage.

Also, as previously discussed, N print synchronization pulses are generated during a major cycle of the printing devices. The N print synchronization pulses are generated such that the print synchronization pulses are uniformly distributed over the distance (i.e., Q inches) the carriage moves during the major cycle. That is, each time the carriage moves Q/N inches, the fire timing controller 14 is configured to generate a print synchronization pulse (so that N print synchronization pulses are generated uniformly over the Q inches the carriage moves during the major cycle).

Figure 4:
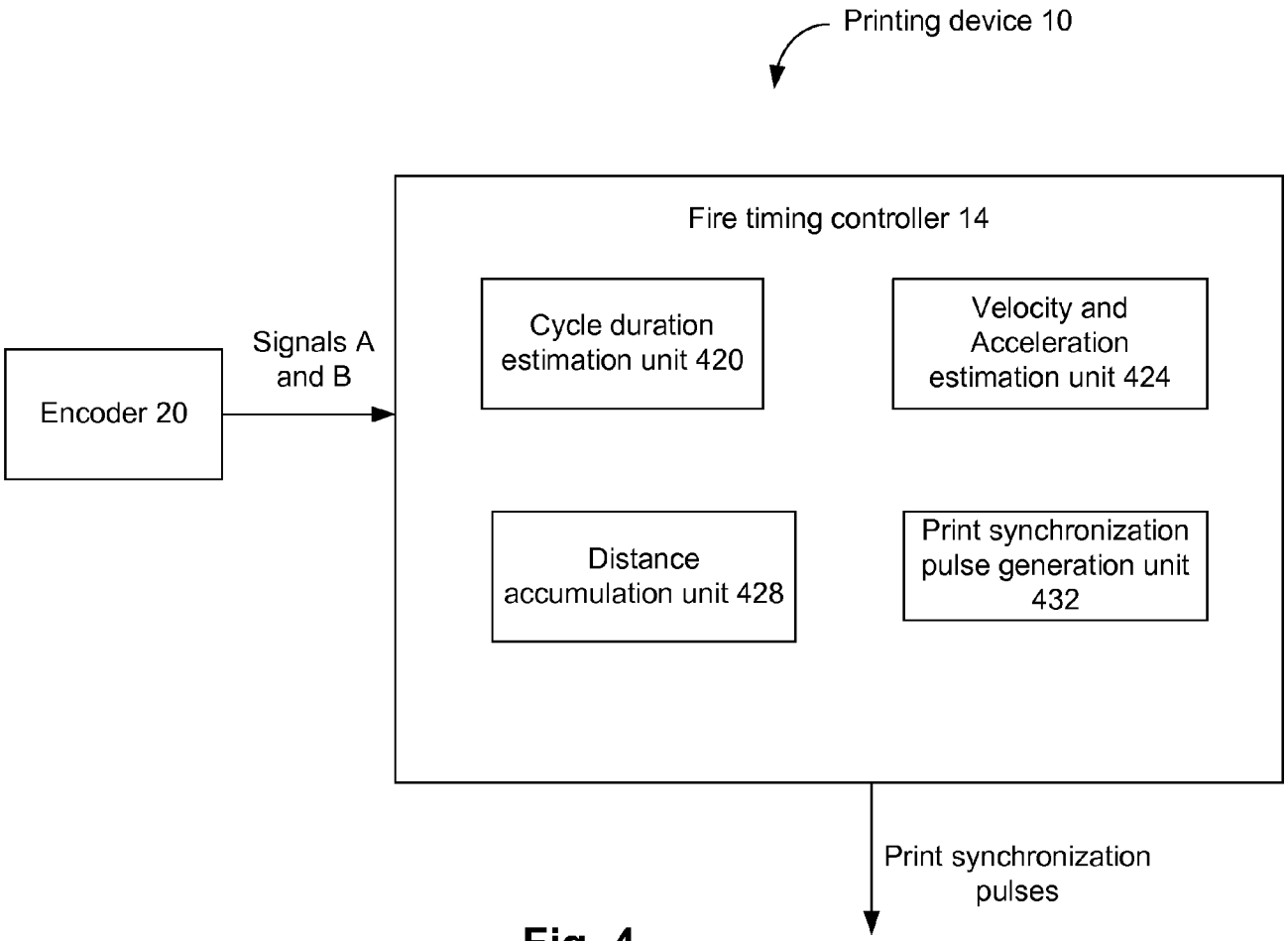
FIG. 4 schematically illustrates in more detail the fire timing controller of the printing device of FIG. 1, in accordance with various embodiments of the present disclosure.

FIG. 4 schematically illustrates in more detail the fire timing controller 14 of the printing device 10 of FIG. 1. The fire timing controller 14 includes a cycle duration estimation unit 420. The fire timing controller 14 receives signals A and B from the encoder 20. Based at least in part on the signals A and B, the cycle duration estimation unit 420 estimates the major cycle duration $t_a$, the first minor cycle duration $t_b$, the second minor cycle duration $t_c$, and the third minor cycle duration $t_d$. The cycle duration estimation unit 420 updates the cycle durations $t_a, \ldots, t_d$ in substantially real time, as the carriage traverses in the primary scanning direction. Thus, the cycle durations $t_a$, $t_b$, $t_c$, and/or $t_d$ are updated each time an edge of signals A and/or B are detected, so that the cycle durations relate to the current time. For example, the cycle duration estimation unit 420 updates the third minor cycle duration $t_d$ each time a falling edge of the signal B is detected, such that the third minor cycle duration $t_d$ reflects time duration between the last two falling edges of the signal B. The other cycle durations $t_a$, $t_b$ and $t_c$ are updated in a similar manner.

In various embodiments, encoder measurement error (e.g., minor encoder timing error, missing detection of an edge of signals A and/or B) and/or encoder noise may occasionally cause large and/or sudden change in the cycle durations $t_a, \ldots, t_d$. This may, in turn, adversely affect estimation of position, velocity and/or acceleration parameters of the carriage. Accordingly, the cycle durations $t_a, \ldots, t_d$ may be filtered to ignore any sudden or large change in one or more of the cycle durations $t_a, \ldots, t_d$.

The fire timing controller 14 also includes a velocity and acceleration estimation unit 424. In various embodiments, the velocity and acceleration estimation unit 424 receives the cycle durations $t_a, \ldots, t_d$, and estimates a velocity and/or an acceleration of the carriage substantially in real time, based on the received cycle durations $t_a, \ldots, t_d$. For example, in one embodiment, the velocity and acceleration estimation unit 424 estimates an initial velocity of the carriage using equation 4, estimates an acceleration of the carriage using equation 5, and updates the velocity estimation using equation 3. In another embodiment, the velocity and acceleration estimation unit 424 estimates the velocity of the carriage using equation 4.

In various embodiments, the velocity and acceleration estimation unit 424 uses a digital form of the equation 3, while updating the velocity estimate of the carriage. For example, the velocity and acceleration estimation unit 424 includes a digital differential analyzer to implement equation 3 while estimating the velocity.

The fire timing controller 14 also includes a distance accumulation unit 428 that receives the estimated velocity and/or acceleration of the carriage, and estimates a current position of the carriage. The distance accumulation unit 428 estimates the position of the carriage in substantially real time using, for example, equation 2. In various embodiments, the distance accumulation unit 428 uses a digital form of the equation 2 (e.g., by using a digital differential analyzer), while estimating the distance.

The fire timing controller 14 also includes a print synchronization pulse generation unit 432 configured to generate print synchronization pulses, based on the position estimate generated by the distance accumulation unit 428.

Also, as previously discussed and as illustrated in FIGS. 2*a*, 2*b* and 3, a print synchronization pulse is generated at the rising edge of the signal A (i.e., at the beginning of a major cycle). Subsequently, each time the carriage moves Q/N inches, the fire timing controller 14 generates a print synchronization pulse, so that N print synchronization pulses are generated uniformly over the Q inches the carriage moves during the major cycle. Thus, each time the distance estimated by the distance accumulation unit 428 increases by about Q/N inches, the print synchronization pulse generation unit 432 generates one print synchronization pulse. Thus, by the end of the major cycle, N print synchronization pulses are generated.

However, because of minor errors in generating the signals A and B, estimating the velocity, acceleration and/or position of the carriage, missing an edge of signals A and/or B, and/or due to any other computational error, in some situations, the generation of the print synchronization pulses may not be fully synchronized with the major cycle. For example, at the end of one of the major cycles, only (N−1) number of print synchronization pulses may be generated.

In such cases, in various embodiments, the print synchronization pulses generation system may be re-synchronized with the next rising edge of signal A (i.e., with the beginning of the next major cycle). In various other embodiments, instead of (or in addition to) such re-synchronization, the system may gradually adjust to or overcome the synchronization error by appropriately updating the various cycle durations $t_a, \ldots, t_d$ with their correct and current values.

Figure 5:
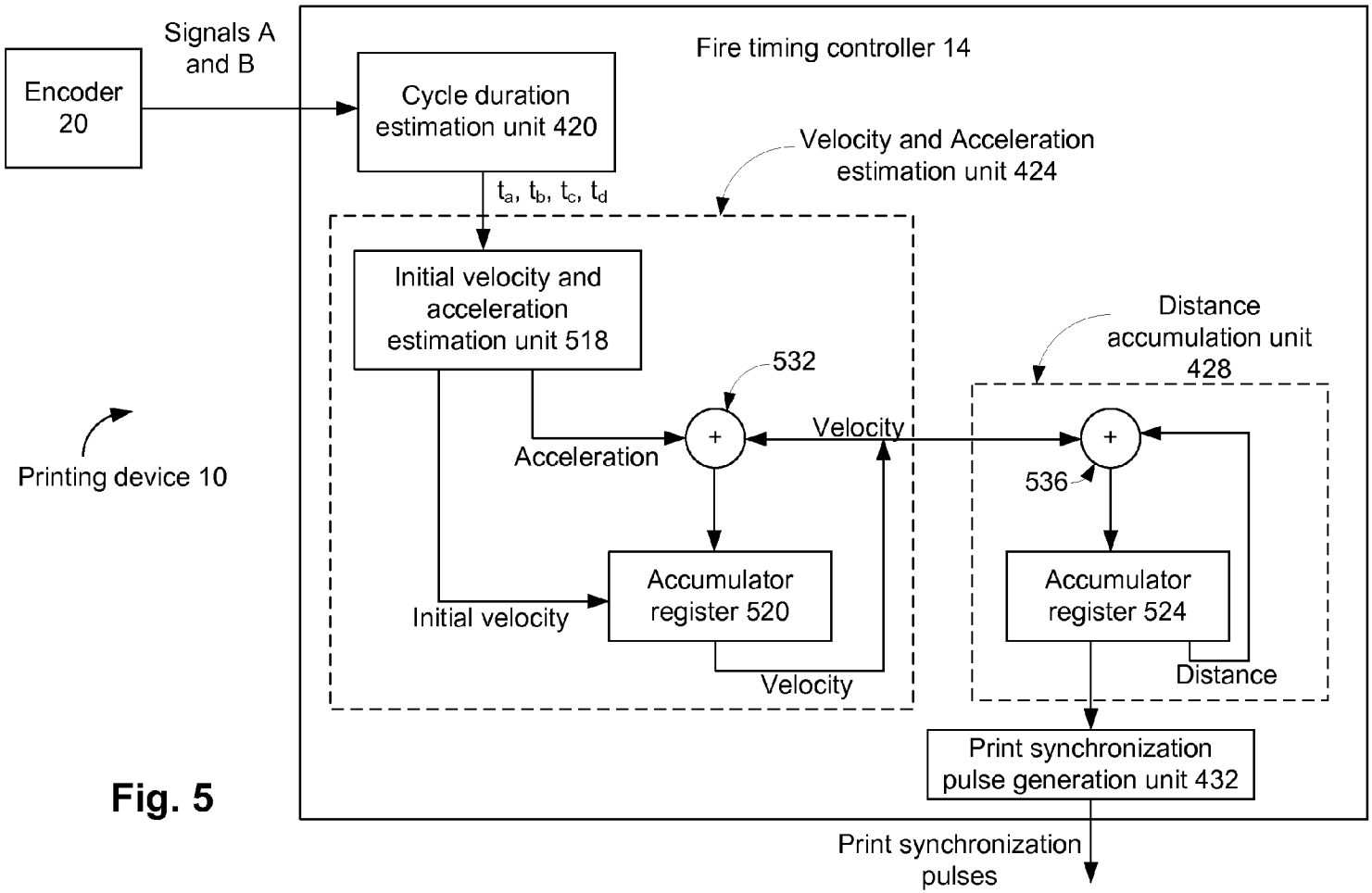
FIG. 5 schematically illustrates in more detail the fire timing controller of the printing device of FIG. 4, in accordance with various embodiments of the present disclosure.

FIG. 5 schematically illustrates in more detail the fire timing controller 14 of the printing device 10 of FIG. 4. As previously discussed, the cycle duration estimation unit 420, included in the fire timing controller 14, receives signals A and B from the encoder 20, and generates cycle durations $t_a, \ldots, t_d$.

The velocity and acceleration estimation unit 424 (illustrated in dotted lines) receives the cycle durations $t_a, \ldots, t_d$ from the cycle duration estimation unit 420, and generates a velocity and acceleration of the carriage, as previously discussed. For example, the velocity and acceleration estimation unit 424 includes an initial velocity and acceleration estimation unit 518, which estimates an initial velocity and acceleration of the carriage using, for example, equations 4 and 5.

The velocity and acceleration estimation unit 424 also includes a first summation unit 532 and a first accumulator register 520. The first summation unit 532 and the first accumulator register 520, in combination, acts as a digital differential analyzer that outputs a velocity of the carriage based on the initial velocity and the acceleration of the carriage. Thus, the digital differential analyzer (comprising the first summation unit 532 and the first accumulator register 520) implements a digital version of equation 3, which estimates a velocity of the carriage from the initial velocity and acceleration of the carriage.

The distance accumulation unit 428 (also illustrated in dotted lines) includes a second summation unit 536 and a second accumulator register 524. The second summation unit 536 and the second accumulator register 524 acts as another digital differential analyzer that outputs a distance (e.g., position) of the carriage based on the velocity of the carriage. Thus, the second accumulator register 524 accumulates the distance (e.g., position $P_d$ of equation 2) the carriage has traversed.

Each time the distance estimated by the distance accumulation unit 428 increases by Q/N inches, the print synchronization pulse generation unit 432 generates one print synchronization pulse.

As the carriage traverses across the printing medium, the ink droplets that are spit by the printing head have the same horizontal velocity as the carriage. Because of the horizontal velocity of the carriage, ink droplets may land on the printing medium ahead of the point from which the ink droplets are spit from the printing head. This effect may be more pronounced when the velocity of the carriage is relatively high. This produces a horizontal shift in the position of the ink droplets, which is usually referred as "time of flight" (TOF) error.

The TOF error effectively shifts an image pixel towards the direction of the carriage sweep, where the amount of shift is based on the carriage velocity, the vertical distance the ink droplets travel before reaching the printing medium (e.g., the distance between the printing head and the printing medium), and/or the like.

If the velocity of the carriage doesn't change and the print sweep is in one direction only, the entire image may be shifted by a small distance because of TOF error, which may not create much visibly undesired effect in the image (as in that case, all the ink droplets are shifted by the same small distance, and in the same direction). However, in case the carriage velocity changes considerably or in case of bi-directional sweep of the carriage, different ink droplets are shifted by different amount, and possibly in different directions. This may create a visibly undesired effect in the image.

Figure 6:
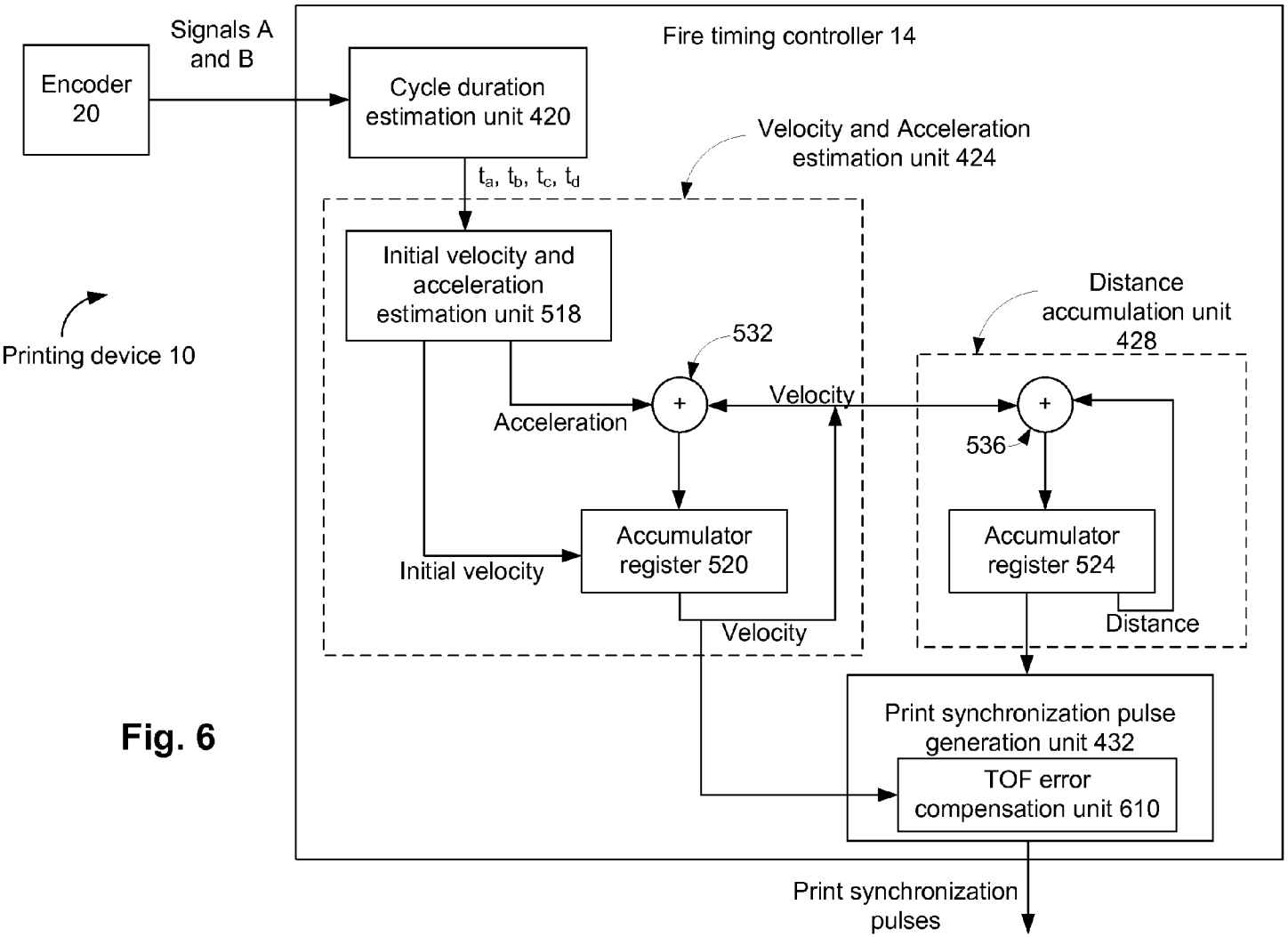
FIG. 6 schematically illustrates a time of flight error compensation unit included in the fire timing controller of FIG. 5, in accordance with various embodiments of the present disclosure.

FIG. 6 schematically illustrates a TOF error compensation unit 610 included in the fire timing controller 14 of FIG. 5, in accordance with various embodiments of the present disclosure. As discussed, the TOF error is based at least in part on the velocity of the carriage. Accordingly, the TOF error compensation unit 610 receives, from the velocity and acceleration estimation unit 424, the estimated velocity of the carriage. Based at least in part on the received velocity, the TOF error compensation unit 610 compensates for the TOF error while the print synchronization pulse generation unit 432 generates the print synchronization pulses.

For example, as the carriage accelerates to a relatively higher velocity, the TOF error compensation unit 610 requires the print synchronization pulse generation unit 432 to look farther ahead to spit ink droplets. Since the ink droplets may land ahead of the current position because of TOF error, the TOF error compensation unit 610 pushes addressing of print data ahead of the current position, based at least in part on the estimated velocity of the carriage. As the carriage decelerates, the amount of TOF compensation shrinks, and the print data addressing is again aligned with the print head position.

Figure 7:
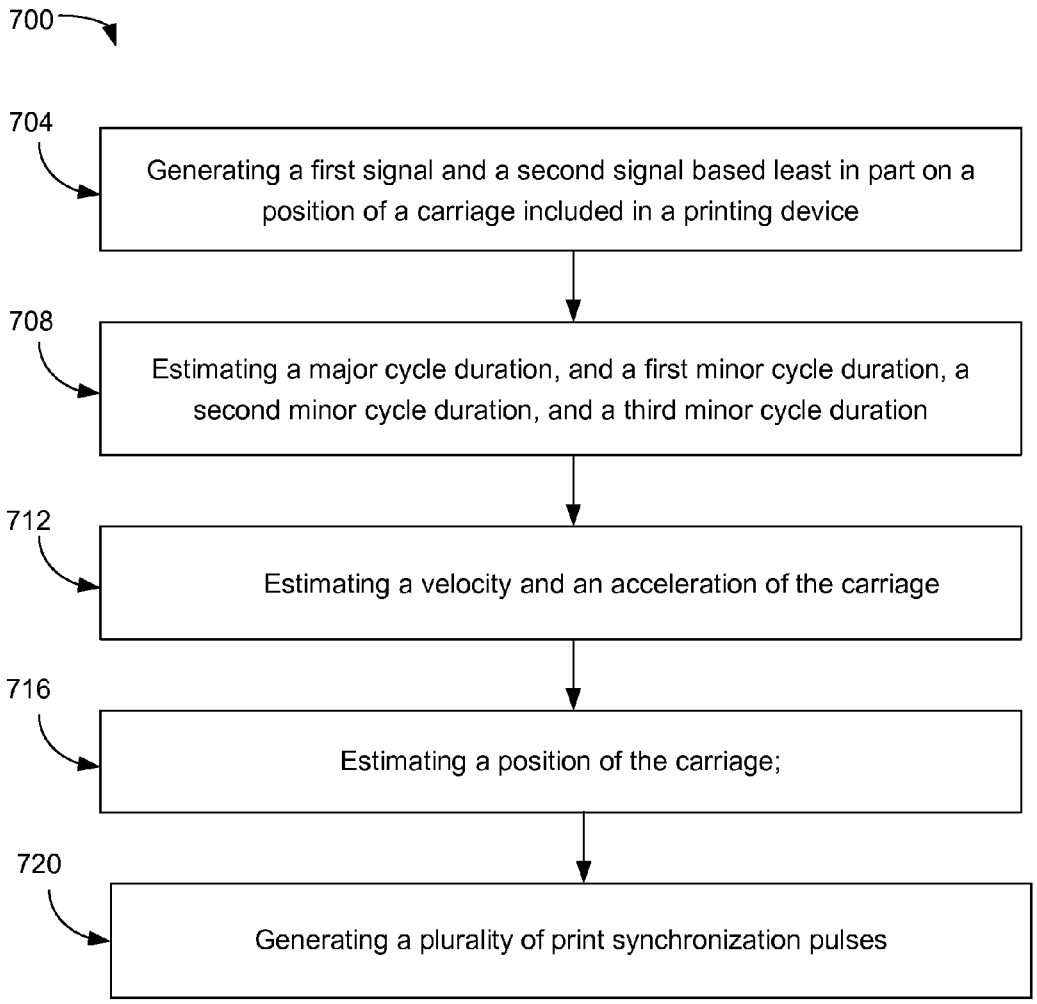
FIG. 7 illustrates a method for generating a plurality of print synchronization pulses in the printing device of FIGS. 1, 4, 5 and/or 6, in accordance with various embodiments of the present disclosure.

FIG. 7 illustrates a method 700 for generating a plurality of synchronization pulses in the printing device 10 of FIGS. 1, 4, 5 and/or 6. The method 700 includes, at 704, generating, by the encoder 20, the first signal A and the second signal B based least in part on a position of the carriage included in the printing device 10.

At 708, the cycle duration estimation unit 420 estimates the major cycle duration $t_a$, the first minor cycle duration $t_b$, the second minor cycle duration $t_c$ and the third minor cycle duration $t_d$.

At 712, the velocity and acceleration estimation unit 424 estimates a velocity and an acceleration of the carriage. For example, the initial velocity and the acceleration of the carriage are estimated using equations 4 and 5. A digital differential analyzer, comprising summation unit 532 and accumulator register 520, updates the velocity of the carriage based on the initial velocity and acceleration, using, for example, an appropriate digital form of equation 3.

At 716, the distance accumulation unit 428 estimates a position of the carriage. For example, a digital differential analyzer, comprising summation unit 536 and accumulator register 524, updates the position of the carriage based on the velocity, using, for example, an appropriate digital form of equation 2.

At 720, the print synchronization pulse generation unit 432 generates a plurality of print synchronization pulses based on the estimated position of the carriage. For example, in various embodiments, the carriage traverses a distance of about Q inches during a major cycle, and the print synchronization pulse generation unit 432 generates N print synchronization pulses during the major cycle, such that the N print synchronization pulses are generated substantially uniformly across the Q inches traversed by the carriage. In case the velocity of the carriage changes during the major cycle, the print synchronization pulse generation unit 432 generates the N print synchronization pulses in non-uniform time interval to compensate for the change in the velocity (e.g., as illustrated in FIG. 3). In various embodiments, the print synchronization pulse generation unit 432 generates a first of the N print synchronization pulses at a start of the major cycle, and generates a print synchronization pulse each time the carriage transverses a distance of about Q/N inches from the start of the major cycle. In various embodiments, while generating the plurality of print synchronization pulses at 720, the TOF error compensation unit 610 compensates for a time of flight error, based at least in part on the estimated velocity of the carriage.

Figure 8:
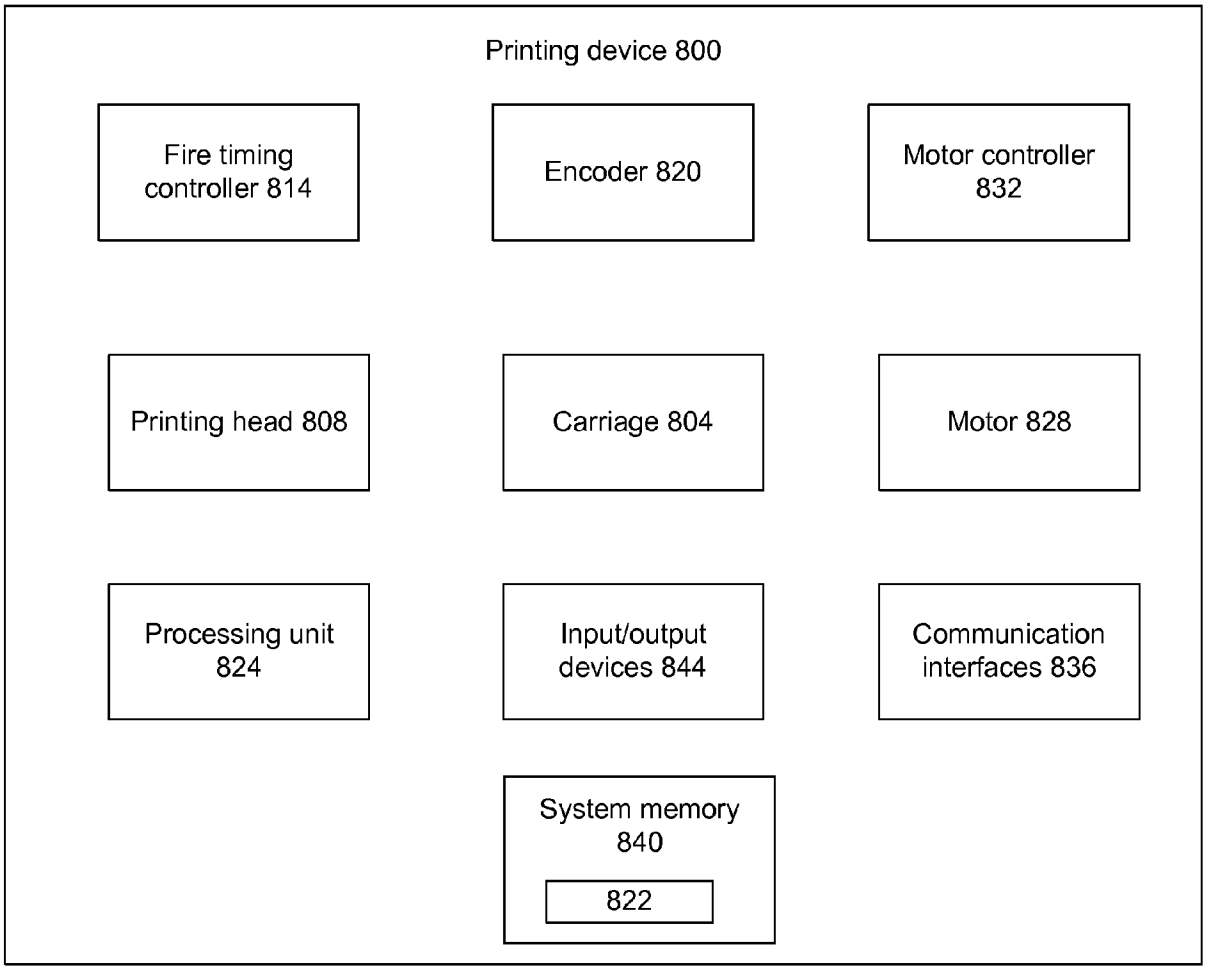
FIG. 8 schematically illustrates a simplified block diagram of a printing device in which embodiments of the present disclosure may be implemented.

FIG. 8 schematically illustrates a simplified block diagram of a printing device 800 in which embodiments of the present disclosure may be implemented. The printing device 800 (e.g., an inkjet printer) includes a motor controller 832 configured to control an operation of a motor 828. The motor 828 drives a carriage 804 (e.g., through a timing belt), such that the carriage 804 traverses in a first direction over a printing medium, the first direction being orthogonal to a direction of traverse of the printing medium. A printing head 808 is configured to be attached to the carriage 804, and to eject ink droplets in the printing medium in synchronization with a plurality of print synchronization pulses.

An encoder 820 is configured to generate a first signal and a second signal based at least in part on a position of the carriage 804. In various embodiments, the encoder 820 is at least in part similar to the encoder 20 of FIGS. 1, 4, 5 and/or 6, and the first signal and the second signal generated by the encoder 820 is similar to previously discussed signal A and signal B, respectively.

A fire timing controller 814 is configured to receive the first signal and the second signal from the encoder 820, to estimate a position of the carriage 804 based at least in part on the first signal and the second signal, and to generate the plurality of print synchronization pulses. The carriage 804 and/or the printing head 808 receives the plurality of print synchronization pulses generated by the fire timing controller 814, and the printing head 814 ejects ink droplets in synchronization with the plurality of print synchronization pulses.

In various embodiments, the fire timing controller 814 is at least in part similar to the fire timing controller 14 of FIGS. 1, 4, 5 and/or 6.

The printing device 800 includes a processing unit 824 and a system memory 840. Additionally, printing device 800 includes input/output devices 844 (such as a display to render visual manifestation, a keypad, and/or the like) and communication interfaces 836 (such as network interface cards, one or more universal serial ports (USB), an Ethernet port, and/or the like).

System memory 840 may be employed to store a working copy and a permanent copy of the programming instructions implementing all or a portion of earlier described functions, herein collectively denoted as 822. The instructions 822 may be assembler instructions supported by processing unit 824 or instructions that can be compiled from high level languages, such as C.

In an embodiment, the processing unit 824 is configured to perform one or more operations of various units illustrated in FIG. 8. For example, the processing unit 824 is configured to control one or more operations of the fire timing controller 814. The processing unit 824 and/or the fire timing controller 814 are configured to perform one or more operations of method 700 of FIG. 7.

In various embodiments, one or components of the printing device may be included in an integrated circuit chip (e.g., in a system on a chip (SOC)). For example, the fire timing controller 814 and the processing unit 824 may be integrated in an integrated chip.

In embodiments of the present disclosure, a machine-readable medium having associated instructions, which, when executed, instructs a machine to implement one or more methods (e.g., method 700 of FIG. 7) as disclosed herein. For example, in example embodiments, a machine-readable medium comprises a storage medium and a plurality of programming instructions stored in the storage medium and adapted to program the machine to generate a first signal and a second signal based least in part on a position of a carriage included in a printing device; estimate a major cycle duration associated with the first signal and a first minor cycle duration associated with the second signal; estimate a position of the carriage based at least in part on the major cycle duration and the first minor cycle duration; and generate a plurality of print synchronization pulses based at least in part on the estimated position of the carriage.

Although specific embodiments have been illustrated and described herein, a wide variety of alternate and/or equivalent implementations may be substituted for the specific embodiment illustrated and described without departing from the scope of the present invention. This present invention covers all methods, apparatus, and articles of manufacture fairly falling within the scope of the appended claims either literally or under the doctrine of equivalents. For example, although the above discloses example systems including, among other components, software or firmware executed on hardware, it should be noted that such systems are merely illustrative and should not be considered as limiting. In particular, it is contemplated that any or all of the disclosed hardware, software, and/or firmware components could be embodied exclusively in hardware, exclusively in software, exclusively in firmware or in some combination of hardware, software, and/or firmware. This application is intended to cover any adaptations or variations of the embodiment discussed herein. Therefore, it is manifested and intended that the invention be limited only by the claims and the equivalents thereof.

The invention claimed is:

1. A printing device comprising:

a carriage configured to traverse over a printing medium;

a sensor attached to the carriage, wherein the sensor is configured to traverse over the printing medium along with the carriage, and wherein the sensor is configured to, based on the traversal of the carriage over the printing medium, generate a first signal and a second signal;

a velocity and acceleration estimation unit configured to estimate, based on both the first signal and the second signal, a velocity of the carriage;

a distance accumulation unit configured to, based on the estimated velocity of the carriage, estimate a position of the carriage as the carriage is being traversed over the printing medium;

a print synchronization pulse generation unit configured to, based on the estimated position of the carriage, generate a stream of print synchronization pulses at a predetermined rate; and a printing head mounted on the carriage, wherein the printing head is configured to eject a printing substance on the printing medium in synchronization with each print synchronization pulse of the stream of print synchronization pulses, wherein the print synchronization pulse generation unit comprises a time of flight error compensation unit configured to, in response to a change in the estimated velocity of the carriage as the carriage is being traversed over the printing medium, adjust the predetermined rate at which the stream of print synchronization pulses are generated to compensate for the change in the estimated velocity of the carriage as the carriage is being traversed over the printing medium.

2. The printing device of claim 1, wherein the time of flight error compensation unit is configured to adjust the predetermined rate at which the stream of print synchronization pulses are generated by:

selectively modifying a timing of generation of one or more print synchronization pulses of the stream of print synchronization pulses.

3. The printing device of claim 1, wherein the sensor comprises:

a light emitting element including (i) a first light emitting section configured to emit light, and (ii) a second light emitting section configured to emit light; and a light receiving element including (i) a first light receiving section configured to selectively receive light from the first light emitting section based on the traversal of the carriage over the printing medium, and (ii) a second light emitting section configured to selectively receive light from the second light emitting section based on the traversal of the carriage over the printing medium, wherein based on light received by the first light receiving section from the first light emitting section, the sensor is configured to generate the first signal, and wherein based on light received by the second light receiving section from the second light emitting section, the sensor is configured to generate the second signal.

4. The printing device of claim 3, further comprising:

a slit tape having a plurality of slits arranged in regular intervals along the slit tape, wherein as the sensor is being traversed over the printing medium along with the carriage, (i) light from the first light emitting section is received by the first light receiving section when the first light emitting section and the first light receiving section are aligned through a slit of the plurality of slits, and (ii) light from the first light emitting section is not received by the first light receiving section when the first light emitting section and the first light receiving section are not aligned through any slit of the plurality of slits.

5. The printing device of claim 3, further comprising:

a slit tape having a plurality of slits arranged in regular intervals along the slit tape, wherein as the sensor is being traversed over the printing medium along with the carriage, (i) light from the first light emitting section is received by the first light receiving section through one or more of the plurality of slits, and (ii) light from the second light emitting section is received by the second light receiving section through one or more of the plurality of slits.

6. The printing device of claim 1, further comprising:

a cycle duration estimation unit configured to receive (i) the first signal, and (ii) the second signal, estimate a first cycle duration associated with the first signal, wherein the first cycle duration corresponds to a time duration between one of (i) a last two rising edges of the first signal, or (ii) a last two falling edges of the first signal, and estimate a second cycle duration associated with the second signal, wherein the second cycle duration corresponds to a time duration between one of (i) a last two rising edges of the second signal, or (ii) a last two falling edges of the second signal, wherein the velocity and acceleration estimation unit is configured to estimate the velocity of the carriage and the acceleration of the carriage based on (i) the first cycle duration associated with the first signal, and (ii) the second cycle duration associated with the second signal.

7. The printing device of claim 6, wherein the cycle duration estimation unit is further configured to:

estimate a third cycle duration associated with the first signal, wherein the third cycle duration corresponds to a time duration between another of (i) the last two rising edges of the first signal, or (ii) the last two falling edges of the first signal, and estimate a fourth cycle duration associated with the second signal, wherein the fourth cycle duration corresponds to a time duration between another of (i) the last two rising edges of the second signal, or (ii) the last two falling edges of the second signal, wherein the velocity and acceleration estimation unit is configured to estimate the velocity of the carriage and the acceleration of the carriage based on (i) the first cycle duration associated with the first signal, (ii) the second cycle duration associated with the second signal, (iii) the third cycle duration associated with the first signal, and (iv) the fourth cycle duration associated with the second signal.

8. The printing device of claim 7, wherein the velocity and acceleration estimation unit is further configured to estimate the acceleration of the carriage such that the estimated acceleration is substantially equal to (Aa*ta+Ba*tb+Ca*tc+Da*td), wherein ta, tb, tc, and td are the first cycle duration, the second cycle duration, the third cycle duration, and the fourth cycle duration, respectively, and wherein Aa, Ab, Ac, and Ad are acceleration weighting coefficients.

9. The printing device of claim 6, wherein the print synchronization pulse generation unit is further configured to generate a plurality of print synchronization pulses during the first cycle duration, such that the plurality of print synchronization pulses are generated substantially uniformly across a distance traversed by the carriage during the first cycle duration.

10. The printing device of claim 9, wherein the print synchronization pulse generation unit is further configured to generate, responsive to a change in the estimated velocity of the carriage during the first cycle duration, the plurality of print synchronization pulses in non-uniform time intervals to compensate for the change in the estimated velocity of the carriage during the first cycle duration.

11. The printing device of claim 1, wherein the velocity and acceleration estimation unit is further configured to:

estimate, based on the first signal and the second signal, (i) an initial velocity of the carriage, and (ii) an acceleration of the carriage; and based on the initial velocity of the carriage and the acceleration of the carriage, estimate the velocity of the carriage.

12. The printing device of claim 1, wherein the printing device is an inkjet printer, and wherein the printing substance comprises ink.

13. A method for adjusting a predetermined rate at which a print head, mounted on a carriage, ejects a printing substance onto a printing medium as the carriage is being traversed over the printing medium, the method comprising:

based on the traversal of the carriage over the printing medium, generating, by a sensor attached to the carriage, (i) a first signal, and (ii) a second signal;

based on the first signal and the second signal, estimating a velocity of the carriage;

based on the estimated velocity of the carriage, estimating a position of the carriage as the carriage is being traversed over the printing medium;

based on the estimated position of the carriage, generating a stream of print synchronization pulses at a predetermined rate, wherein the print head is configured to eject the printing substance on the printing medium in synchronization with each print synchronization pulse of the stream of print synchronization pulses, and wherein the method further comprises in response to a change in the estimated velocity of the carriage as the carriage is being traversed over the printing medium, adjusting the predetermined rate at which the stream of print synchronization pulses are generated to compensate for the change in the estimated velocity of the carriage as the carriage is being traversed over the printing medium.

14. The method of claim 13, wherein adjusting the predetermined rate at which the stream of print synchronization pulses are generated comprises:

selectively modifying a timing of generation of one or more print synchronization pulses of the stream of print synchronization pulses.

15. The method of claim 13, wherein the sensor comprises:

a light emitting element including (i) a first light emitting section configured to emit light, and (ii) a second light emitting section configured to emit light; and a light receiving element including (i) a first light receiving section configured to selectively receive light from the first light emitting section, and (ii) a second light emitting section configured to selectively receive light from the second light emitting section, wherein generating, by the sensor attached to the carriage, (i) the first signal, and (ii) the second signal comprises (i) based on light received by the first light receiving section from the first light emitting section, generating the first signal, and (ii) based on light received by the second light receiving section from the second light emitting section, generating the second signal.

16. The method of claim 13, further comprising:

estimating a first cycle duration associated with the first signal, wherein the first cycle duration corresponds to a time duration between one of (i) a last two rising edges of the first signal, or (ii) a last two falling edges of the first signal;

estimating a second cycle duration associated with the second signal, wherein the second cycle duration corresponds to a time duration between one of (i) a last two rising edges of the second signal, or (ii) a last two falling edges of the second signal, wherein estimating the velocity of the carriage further comprises based on (i) the first cycle duration associated with the first signal, and (ii) the second cycle duration associated with the second signal, estimating the velocity of the carriage.

17. The method of claim 16, further comprising:

estimating a third cycle duration associated with the first signal, wherein the third cycle duration corresponds to a time duration between another of (i) the last two rising edges of the first signal, or (ii) the last two falling edges of the first signal; and estimating a fourth cycle duration associated with the second signal, wherein the fourth cycle duration corresponds to a time duration between another of (i) the last two rising edges of the second signal, or (ii) the last two falling edges of the second signal, wherein estimating the velocity of the carriage further comprises based on (i) the first cycle duration associated with the first signal, (ii) the second cycle duration associated with the second signal, (iii) the third cycle duration associated with the first signal, and (iv) the fourth cycle duration associated with the second signal, estimating the velocity of the carriage.

18. The method of claim 17, further comprising:

estimating an acceleration of the carriage such that the estimated acceleration is substantially equal to (Aa*ta+Ba*tb+Ca*tc+Da*td), wherein ta, tb, tc, and td are the first cycle duration, the second cycle duration, the third cycle duration, and the fourth cycle duration, respectively, and wherein Aa, Ab, Ac, and Ad are acceleration weighting coefficients.

19. The method of claim 15, wherein generating the stream of print synchronization pulses further comprises:

generating the stream of print synchronization pulses such that (i) a plurality of print synchronization pulses are generated during the first cycle duration, and (ii) the plurality of print synchronization pulses are generated substantially uniformly across a distance traversed by the carriage during the first cycle duration.

20. The method of claim 19, wherein, responsive to a change in the estimated velocity of the carriage during the first cycle duration, the plurality of print synchronization pulses are generated in non-uniform time intervals to compensate for the change in the estimated velocity of the carriage during the first cycle duration.

* * * * *